United States Patent [19]

Satake et al.

[11] 4,295,420

[45] Oct. 20, 1981

[54] AUTOMATIC CONTROL SYSTEM FOR HULLING MACHINE

[75] Inventors: Toshihiko Satake; Akira Kono; Takashi Horie; Yasuharu Mitoma, all of Higashihiroshima, Japan

[73] Assignee: Satake Engineering Co., Ltd., Tokyo, Japan

[21] Appl. No.: 109,634

[22] Filed: Jan. 4, 1980

[30] Foreign Application Priority Data

Feb. 23, 1979 [JP] Japan ..... 54-6820
Mar. 13, 1979 [JP] Japan ..... 54-28298

[51] Int. Cl.[3] ..... B02B 3/04

[52] U.S. Cl. ..... 99/486; 99/523; 99/618; 99/620; 99/621; 100/47; 241/37

[58] Field of Search ..... 99/486, 488, 489, 492, 99/523, 524, 618–622, 574, 575; 100/47; 241/37

[56] References Cited

U.S. PATENT DOCUMENTS 3,179,140 4/1965 Satake ..... 99/488
3,468,488 9/1969 Karrer et al. ..... 241/37
4,066,012 1/1978 Satake et al. ..... 99/621
4,140,285 2/1979 Linzberger et al. ..... 241/37

*Primary Examiner*—Philip R. Coe
*Assistant Examiner*—Timothy F. Simone
*Attorney, Agent, or Firm*—Norbert P. Holler; Charles A. Blank

[57] ABSTRACT

An automatic control system for a hulling machine including a fixed rotary hulling roll, a movable rotary hulling roll, means for moving the movable rotary hulling roll toward and away from the fixed rotary hulling roll to adjust the gap between the two hulling rolls and a main electric motor for driving the two hulling rolls. The system includes load detecting means for detecting the load applied to the main electric motor, and control means for connecting the load detecting means to the means for controlling the movement of the auxiliary shaft whereby the gap between the two hulling rolls can be automatically adjusted in accordance with the load applied to the main electric motor.

14 Claims, 3 Drawing Figures

AUTOMATIC CONTROL SYSTEM FOR HULLING MACHINE

BACKGROUND OF THE INVENTION

This invention relates to a control system for a hulling machine.

In a hulling machine of the prior art comprising a hulling roll supported on a fixed main rotary shaft, another hulling roll supported on a movable auxiliary rotary shaft arranged parallel to the fixed main rotary shaft, a main electric motor for driving the two hulling rolls, and means for controlling the movement of the movable auxiliary rotary shaft, no technical concept is adopted whereby the gap between the two hulling rolls is automatically adjusted in accordance with a variation in the load during a hulling operation to thereby stabilize the load. Therefore, when the hulling machine is constructed such that resilient means or fluid pressure means is utilized for forcing the hulling roll on the movable auxiliary rotary shaft toward the hulling roll on the fixed main rotary shaft at a predetermined pressure, the two hulling rolls are brought into contact with the material to be hulled supplied to the nip thereof under a constant total pressure at all times regardless of a variation in the amount of the material such as unhulled rice or other grain. Thus when the supplied unhulled rice is small in amount, the unhulled rice may be damaged or portions of the hulling rolls may be brought into direct contact with each other, thereby causing wear on the hulling rolls.

SUMMARY OF THE INVENTION

This invention obviates the aforesaid disadvantages of the prior art. Accordingly the invention has as its object the provision of an automatic control system for a hulling machine capable of automatically keeping the hulling load applied to the main electric motor for driving the hulling rolls at a safe level at all times, increasing the hulling rate and improving the quality of the hulled rice or brown rice obtained by a hulling operation while at the same time permitting accidents to be prevented from happening and allowing the hulling operation to be practiced with minimum labor.

To accomplish the aforesaid object, according to the present invention, there is provided, in the hulling machine of the type described hereinabove, a control system comprising load detecting means mounted on the main electric motor for driving the hulling rolls for detecting the load applied to the main electric motor, and control means interposed between the load detecting means and movement control means for the movable auxiliary rotary shaft, whereby the movement of the movable auxiliary rotary shaft toward and away from the fixed main rotary shaft can be controlled in accordance with a variation in the load applied to the main electric motor and the gap between the hulling rolls mounted on the two shafts can be automatically adjusted.

DESCRIPTION OF THE PREFERRED EMBODIMENTS

Figure 1:
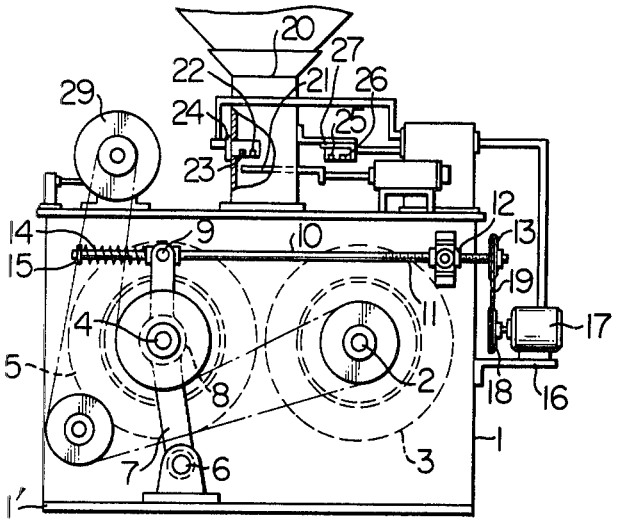
FIG. 1 is a front view of the hulling machine incorporating therein the automatic control system comprising one embodiment of the invention.

In FIG. 1, the hulling machine comprises a machine frame 1, a hulling roll 3 supported on a fixed main rotary shaft 2 in the machine frame 1 and another hulling roll 5 supported on a movable auxiliary rotary shaft 4 in the machine frame 1. The auxiliary shaft 4 is journalled by a bearing 8 mounted on an arm 7 pivotally supported by a base shaft 6 supported on an extension 1' of the machine frame 1, so that the auxiliary shaft 4 can move toward and away from the main shaft 2 in parallel relation thereto at all times. The arm 7 is bifurcated at its free end for supporting a receiving metal member 9 for free movement. The receiving metal member 9 is formed therein with an aperture through which one end portion of a rod 10 extends for rotary and sliding movements, the rod 10 being formed at the other end portion with a threaded portion 11 in threadable engagement with a nut member 12 pivotally supported by a wall of the machine frame 1. A sprocket wheel 13 is mounted on the threaded portion 11 and the rod rotates together with the sprocket wheel 13. Means for permitting the axial movement of the rod 10 relative to the sprocket wheel 13 is provided. Such means may comprise, for example, an axial keyway, not shown, formed in the threaded portion 11, and a key, not shown, projecting inwardly from the inner periphery of the sprocket wheel 13 and engaged in the keyway.

A coil spring 14 is mounted around said one end portion of the rod 10 and abuts at one end thereof against a nut 15 threadably connected to the end of the rod 10 and at the other end thereof against the receiving metal member 9. A bracket 16 connected to the wall of the machine frame 1 supports thereon a reversible electric motor 17 for effecting adjustment of the gap between the hulling rolls having a sprocket wheel 18 supported on its output shaft. A chain 19 is trained over the sprocket wheel 18 and the sprocket wheel 13 on the rod 10. The reversible electric motor 17 for effecting gap adjustments may be an induction motor, servomotor or a pulse motor.

When the electric motor 17 rotates in one of the normal and reverse directions, the rotation is transmitted by way of the sprocket wheel 13 to the rod 10 which is moved either rightwardly (when the motor 7 rotates in the normal direction) or leftwardly (when the motor 7 rotates in the reverse direction) in FIG. 1 by the threadable engagement of the threaded portion 11 with the nut member 12. Thus the auxiliary shaft 4 can be moved toward and away from the main shaft 2 by pivotally moving the arm 7, thereby adjusting the gap between the two hulling rolls 3 and 5.

It will be understood that the base shaft 6, arm 7, bearing 8, receiving metal member 9, rod 10, threaded portion 11, nut member 12, sprocket wheel 13, coil spring 14, nut 15, reversible motor 17, sprocket wheel 18 and chain 19 constitute means for controlling the movement of the auxiliary shaft 4.

The hulling machine further comprises a hopper 20 for supplying unhulled rice to the hulling rolls 3 and 5, and an on-off valve 21 mounted in the hopper 20. Mounted above the on-off valve 21 is an unhulled rice level detector 24 including a light-emitting diode 22 and a photo detector 23 for detecting the light reflected by the unhulled rice as the light emanating from the light-emitting diode 22 is incident thereon. The diode 22 and detector 23 are mounted as a set on a block. The circuit of the unhulled rice level detector 24 and the signal circuit of a sensor 27 sensing the opening or closing of the on-off valve 21 operating between a light-emitting diode 25 and a photo detector 26 and generating a signal are connected to an AND circuit 28 shown in FIG. 2. The AND circuit 28 is connected to a control circuit 31 connected to a current transformer 30 serving as load detecting means mounted in the main circuit of a main electric motor 29 connected to the main shaft 2 and the auxiliary shaft 3 supporting the hulling rolls 3 and 5 respectively. The control circuit 31 has mounted at two output terminals thereof relays 32 and 33 which are connected at the output end thereof to the reversible electric motor 17 for effecting gap adjustments. The control circuit 31 includes an integrator 34, limit setters 35 and 36, and AND circuits 37 and 38 and functions as a control system. The details of the control system are subsequently to be described by referring to its electric circuit diagram.

In operation, unhulled rice is supplied through the hopper 20 to the gap between the two hulling rolls 3 and 5 to carry out a hulling operation. If the gap is two small relative to the amount of unhulled rice supplied through the hopper 20, then an overload is applied to the main electric motor 29 whose load current increases in value. When the load current exceeds the upper limit, an upper limit setter 36 supplies a signal to the relay 33 to cause the reversible motor 17 to rotate in the reverse direction. This moves the auxiliary shaft 4 away from the mainshaft 2 to thereby increase the gap between the two hulling rolls 3 and 5 and keep the load at a safe level. If the gap is too large relative to the amount of unhulled rice supplied through the hopper 20, a lower limit setter 35 supplies a signal to the relay 32 so as to cause the motor 17 to rotate in the normal direction to adjust the load to a normal level. The reversible electric motor 17 for effecting gap adjustments has its circuit blocked by a signal supplied by the unhulled rice level detector 24 when there is no unhulled rice in the hopper 20 and by a signal supplied by the sensor 27 when the on-off valve 21 is closed, so that there is no danger of the current being passed to the motor 17. It is only when there is unhulled rice in the hopper 20 and the on-off valve 21 is open that a current is passed to the reversible electric motor 17 for rotating same either in the normal or reverse direction.

The electric circuit shown in FIG. 2 will be described in detail. An electromagnetic contactor contact MC is mounted in the main circuit connecting power source terminals R. S and T to the main electric motor 29, and a contactor magnetic coil MC' and a button switch ST are connected in series between the terminals R and S. Mounted in the circuit of terminal T is the current transformer 30 having connected to its output end the control system 31 having the input of the integrator 34 connected to the output end of the current transformer 30 and mounting a rectifier 39 and an overcurrent protector 40 between the current transformer 30 and integrator 34. The output of the integrator 34 branches off and has one input terminal of the limit setter 35 connected to one end thereof and has one input terminal of the other limit setter 36 connected to the other end thereof. The limit setter 36 has connected to the other input terminal thereof an upper limit setting resistor 41, and the limit setter 35 has connected to the other input terminal thereof a lower limit setting resistor 42. The AND circuit 37 has connected to one input terminal thereof the output of the limit setter 35 and to the other input terminal thereof the output of the AND circuit 28. The AND circuit 37 is connected at its output terminal to the reversible electric motor 17, and the normal direction relay 32 is mounted therebetween. The AND circuit 38 has connected to one input terminal thereof the output of the limit setter 36 and to the other input terminal thereof the output terminal of the AND circuit 28. The output terminal of the AND circuit 38 is connected to the reversible electric motor 17, and the reverse direction relay 33 is mounted therebetween. One input terminal of the AND circuit 28 is connected to the photo detector 23 of the unhulled rice level detector 24 and the other input terminal thereof is connected to the photo detector 26 of the sensor 27. Thus when the gap between the two hulling rolls 3 and 5 becomes too narrow and the load current of the main electric motor 29 exceeds the set value of the upper limit setting resistor 41, the limit setter 36 generates an output signal; when the gap becomes too great and the load current becomes smaller than the set value of the lower limit setting resistor 42, the limit setter 35 generates an output signal. The signals of the limit setters 35 and 36 suitably actuate the relays 32 and 33 respectively by a signal indicative of the coincidence of the outputs of the unhulled rice level detector 24 and the sensor 27, thereby causing the reversible electric motor 17 to rotate either in the normal direction or the reverse direction to keep the gap between the hulling rolls 3 and 5 at a normal level at all times.

The second embodiment will now be described by referring to FIG. 3, in which mechanical means including the rod 10, threaded portion 11, nut member 12, sprocket wheel 13, coil spring 14, nut 15, sprocket wheel 18 and chain 19 constituting the means for controlling the movement of the auxiliary shaft shown in FIG. 1 is replaced by fluid pressure means.

More specifically, the machine frame 1 has secured thereto a bracket 43 on which a hydraulic cylinder 45, a sort of fluid pressure means, is pivotally mounted between two upstanding lugs 44. A piston rod 46 connected to a piston, not shown, in the hydraulic cylinder 45 and projecting outwardly therefrom is connected at its free end to the receiving metal member 9 movably supported by the bifurcation formed at the free end of the arm 7 pivotally movable about the base shaft 6 in the same manner as described with reference to the embodiment shown in FIG. 1. Supply and discharge conduits 47 each connected to one of opposite ends of the hydraulic cylinder 45 are connected to one side of a change-over valve 38 mounted on the extension 1' of the machine frame 1. The other side of the change-over valve 48 is connected to an oil supply conduit 51 connected to an oil tank 50 and having an oil supply pump 49 mounted therein, and an oil return conduit 52 opening at the top of the oil tank 50. The change-over valve 48 is operatively connected, via a gear train 53 constituting actuating means, to the reversible electric motor 17 for effecting gap adjustments.

By rotating the electric motor 17 either in the normal direction or reverse direction, the change-over valve 48 is actuated to switch so as to introduce oil via one supply and discharge conduit 47 from the oil supply pump 49 to one end of the hydraulic cylinder 45 and to connect the other end of the hydraulic cylinder 45 to the oil return conduit 52 by way of the other oil supply and discharge conduit 47. This causes the piston rod 46 to move into and out of the hydraulic cylinder 45 to move the receiving metal member 9 connected to the piston rod 46 rightwardly or leftwardly in FIG. 3, to thereby pivotally move the arm 7 rightwardly or leftwardly about the base shaft 6. This moves the hulling roll 5 supported by the arm 7 toward or away from the hulling roll 3.

Figure 2:
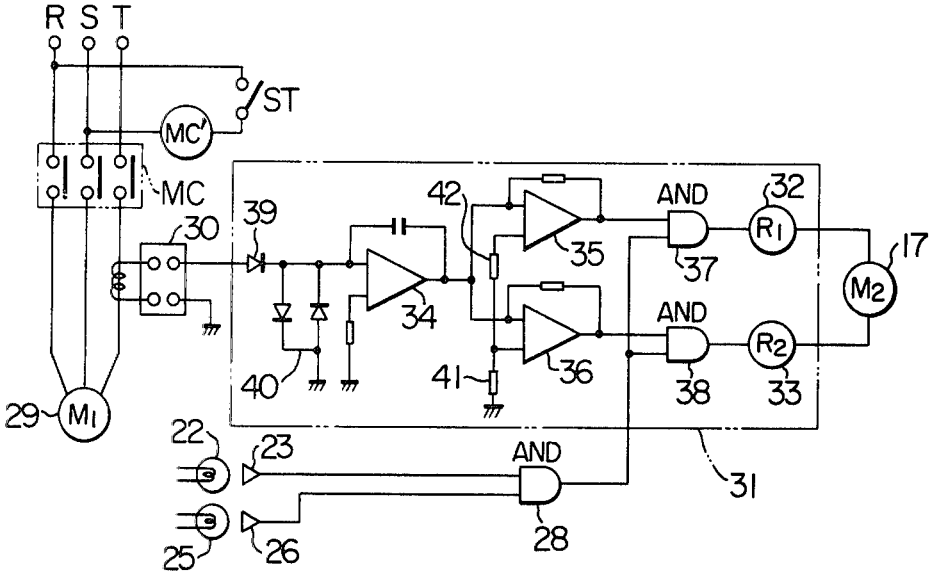
FIG. 2 is a diagram of the electric circuit for the embodiment shown in FIG. 1.
Figure 3:
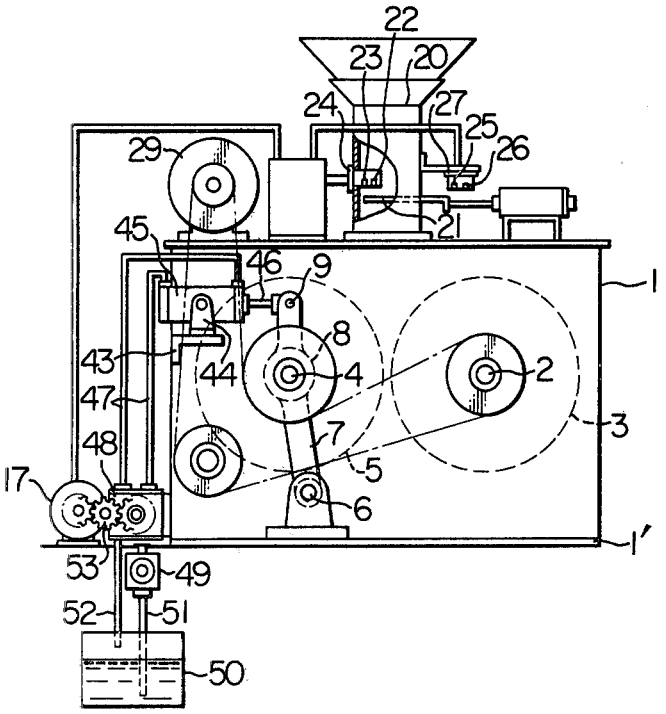
FIG. 3 is a front view of the hulling machine incorporating therein the automatic control system comprising another embodiment.

Except for the aforeasaid construction, the embodiment shown in FIG. 3 is similar to that shown in FIG. 1, and an electric circuit for controlling the reversible electric motor 17 for effecting gap adjustments operatively connected to the change-over valve 48 is similar to that shown in FIG. 2, so that the description thereof will be omitted.

When unhulled rice is supplied to the gap between the two hulling rolls 3 and 5 through the hopper 20 to perform a hulling operation, an overload is applied to the main electric motor 29 if the gap is too narrow relative to the amount of the unhulled rice supplied thereto. As a result, the load current to the motor 29 increases in value and as the value exceeds the upper limit, the upper limit setter 36 transmits a signal to the relay 33 to rotate the motor 17 in the reverse direction and actuates the change-over valve 48. The change-over valve 48 are switched to supply oil to the end of the hydraulic cylinder 45 near to the receiving metal member 9 to retract the piston rod. This moves the auxiliary shaft 4 away from the main shaft 2 to increase the gap between the rolls 3 and 5 and adjust the load. When the gap between the two rolls 3 and 5 is too large relative to the amount of unhulled rice supplied thereto, the lower limit setter 35 supplies a signal to the relay 32 to rotate the electric motor 17 in the normal direction. As a result, the change-over valve 48 are switched through the actuating means 53 to move the arm 7 rightwardly through the hydraulic cylinder 45, to thereby narrow the gap between the rolls 3 and 5 to adjust the load to the normal level. The reversible electric motor 17 for effecting gap adjustments has its circuit blocked by a signal from the unhulled rice level detector 24 when there is no unhulled rice in the hopper 20 and by a signal from the sensor 27 when the on-off valve 21 is closed, in the same manner as described with reference to the embodiment shown in FIG. 1, so that there is no danger of a current passing to the motor 17.

It the embodiment shown in FIG. 3 and described hereinabove, control of the movement of the auxiliary shaft 4 is effected by means of a fluid pressure cylinder, so that adjustments can be effected positively and readily with a strong force. It is to be understood that gas or liquid may be used with the fluid pressure means.

From the foregoing description, it will be appreciated that according to the present invention there is provided, in a hulling machine comprising a hulling roll supported on a fixed main rotary shaft, another hulling roll supported on a movable auxiliary rotary shaft disposed parallel to the fixed main rotary shaft, a main electric motor for driving the hulling rolls and means for controlling the movement of the movable auxiliary rotary shaft, an automatic control system for the hulling machine wherein the circuit of a reversible electric motor for effecting gap adjustments which actuates the means for controlling the movement of the auxiliary shaft mechanically (first embodiment) or by fluid pressure (second embodiment) is connected to the circuit of load detecting means mounted in the circuit of the main electric motor through a control circuit. The automatic control system is effective to adjust the gap between the two hulling rolls in accordance with the load applied to the main electric motor. Thus the load can be stabilized at all times regardless of changes in the amount of unhulled rice supplied to the gap between the two hulling rolls, a hulling operation can be practiced safely with no undue stresses being applied to the hulling machine and at a stable hulling rate, protection can be provided to hulled or brown rice obtained by the hulling operation, accidents can be prevented, the service life of each hulling roll can be prolonged, and efficiency can be markedly increased in operation. In addition, automatic control made possible by the automatic control system is conducive to labor saving.

In the embodiments shown and described hereinabove, the movement of the auxiliary shaft is effected by the pivotal movement of an arm. It is to be understood, however, that the invention is not limited to this specific arrangement and that other arrangement, such as guide rails fixed to the machine frame for moving the auxiliary shaft therealong, may be used to attain the end.

What is claimed is:

1. In a hulling machine comprising a hulling roll supported on a fixed main rotary shaft, another hulling roll supported on a movable auxiliary rotary shaft disposed parallel to said fixed main rotary shaft, a main electric motor for driving said two hulling rolls, means for supplying unhulled rice to the gap between said two hulling rolls and means for controlling the movement of the movable auxiliary rotary shaft, an automatic control system comprising:

(a) load detecting means for detecting the load applied to said main electric motor; and (b) control means for connecting said load detecting means to said means for controlling the movement of the auxiliary rotary shaft.

2. An automatic control system as claimed in claim 1, wherein said load detecting means comprises a current transformer included in the circuit of said main electric motor.

3. An automatic control system as claimed in claim 1 or 2, wherein said means for controlling the movement of the auxiliary shaft includes a reversible electric motor for effecting gap adjustments.

4. An automatic control system as claimed in claim 3, wherein said control means comprises a control circuit for connecting said load detecting means for detecting the load applied to said main electric motor to said reversible electric motor for effecting gap adjustments of said means for controlling the movement of the auxiliary shaft, and wherein said control circuit comprises an upper limit setter and a lower limit setter connected to said load detecting means, and a reverse rotation relay and a normal rotation relay for said reversible electric motor for effecting adjustment, said reverse rotation relay and said normal rotation relay being connected to said upper limit detector and said lower limit detector respectively.

5. An automatic control system as claimed in claim 4, wherein said control circuit includes AND circuits each connected between one of said upper limit setter and said lower limit setter and one of said reverse rotation relay and said normal rotation relay, and wherein said means for supplying unhulled rice to the gap between the two hulling rolls comprises an on-off valve, a sensor for sensing whether said on-off valve is open or closed, an unhulled rice level detector disposed upstream of said on-off valve, and an AND circuit inputing a signal from said sensor and a signal from said unhulled rice level detector and connected at its output terminal to one input terminal of each of said AND circuits of said control circuit.

6. An automatic control system as claimed in claim 3, wherein said means for controlling the movement of the auxiliary shaft comprises a base shaft supported by a machine frame of said hulling machine, an arm pivotally supported by said base shaft and provided with a bearing for rotatably journalling said auxiliary shaft, a rod operatively connected at one end to a free end of said arm through a coil spring and formed at the other end portion with a threaded portion, a nut member supported on said machine frame for threadable engagement with said threaded portion of said rod, and means for drivingly connecting said rod to said reversible electric motor for effecting gap adjustments.

7. An automatic control system as claimed in claim 3, wherein said means for controlling the movement of the auxiliary shaft comprises a base shaft supported on a machine frame of said hulling machine, an arm pivotally supported by said base shaft and provided with a bearing for rotatably journalling said auxiliary shaft, a fluid pressure cylinder supported by said machine frame and having a piston rod inserted therein and connected at its outer end to a free end of said arm, a change-over valve for switching a working fluid connected to said fluid pressure cylinder, and means for actuatingly connecting said change-over valve to said reversible electric motor for effecting gap adjustments.

8. The combination comprising:

a hulling machine comprising a hulling roll supported on a fixed main rotary shaft, another hulling roll supported on a movable auxiliary rotary shaft disposed parallel to said fixed main rotary shaft, a main electric motor for driving said two hulling rolls, means for supplying unhulled rice to the gap between said two hulling rolls and means for controlling the movement of the movable auxiliary rotary shaft; and an automatic control system comprising load detecting means for detecting the load applied to said main electric motor, and control means for connecting said load detecting means to said means for controlling the movement of the auxiliary rotary shaft.

9. The combination as claimed in claim 8, wherein said load detecting means comprises a current transformer included in the circuit of said main electric motor.

10. The combination as claimed in claim 8 or 9, wherein said means for controlling the movement of the auxiliary shaft includes a reversible electric motor for effecting gap adjustments.

11. The combination as claimed in claim 10, wherein said control means comprises a control circuit for connecting said load detecting means for detecting the load applied to said main electric motor to said reversible electric motor for effecting gap adjustments of said means for controlling the movement of the auxiliary shaft, and wherein said control circuit comprises an upper limit setter and a lower limit setter connected to said load detecting means, and a reverse rotation relay and a normal rotation relay for said reversible electric motor for effecting adjustment, said reverse rotation relay and said normal rotation relay being connected to said upper limit detector and said lower limit detector respectively.

12. The combination as claimed in claim 11, wherein said control circuit includes AND circuits each connected between one of said upper limit setter and said lower limit setter and one of said reverse rotation relay and said normal rotation relay, and wherein said means for supplying unhulled rice to the gap between the two hulling rolls comprises an on-off valve, a sensor for sensing whether said on-off valve is open or closed, an unhulled rice level detector disposed upstream of said on-off valve, and an AND circuit inputing a signal from said sensor and a signal from said unhulled rice level detector and connected at its output terminal to one input terminal of each of said AND circuits of said control circuit.

13. The combination as claimed in claim 10, wherein said means for controlling the movement of the auxiliary shaft comprises a base shaft supported by a machine frame of said hulling machine, an arm pivotally supported by said base shaft and provided with a bearing for rotatably journalling said auxiliary shaft, a rod operatively connected at one end to a free end of said arm through a coil spring and formed at the other end portion with a threaded portion, a nut member supported on said machine frame for threadable engagement with said threaded portion of said rod, and means for drivingly connecting said rod to said reversible electric motor for effecting gap adjustments.

14. The combination as claimed in claim 10, wherein said means for controlling the movement of the auxiliary shaft comprises a base shaft supported on a machine frame of said hulling machine, an arm pivotally supported by said base shaft and provided with a bearing for rotatably journalling said auxiliary shaft, a fluid pressure cylinder supported by said machine frame and having a piston rod inserted therein and connected at its outer end to a free end of said arm, a change-over valve for switching a working fluid connected to said fluid pressure cylinder, and means for actuatingly connecting said change-over valve to said reversible electric motor for effecting gap adjustments.

* * * * *